US005124729A

United States Patent [19]

Nakazawa et al.

[11] Patent Number: 5,124,729

[45] Date of Patent: Jun. 23, 1992

[54] RECORDING APPARATUS

[75] Inventors: Akira Nakazawa, Isehara; Noboru Takada, Atsugi; Shigeo Nonoyama, Kawasaki; Mitsuo Ozaki, Atsugi; Kohei Kiyota, Machida, all of Japan

[73] Assignee: Fujitsu Limited, Kanagawa, Japan

[21] Appl. No.: 548,890

[22] PCT Filed: Mar. 14, 1990

[86] PCT No.: PCT/JP90/00335

§ 371 Date: Jul. 23, 1990

§ 102(e) Date: Jul. 23, 1990

[87] PCT Pub. No.: WO90/10542

PCT Pub. Date: Sep. 20, 1990

[30] Foreign Application Priority Data

Mar. 15, 1989 [JP] Japan ..... 1-61051

[51] Int. Cl.[5] ..... B41J 2/06; B41J 2/385

[52] U.S. Cl. ..... 346/140 R; 346/153.1; 101/DIG. 37

[58] Field of Search ..... 346/140 R, 153.1; 101/DIG. 37, 122, 170; 400/126

[56] References Cited

U.S. PATENT DOCUMENTS 3,834,301 9/1974 Croquelois et al. ..... 101/DIG. 37
3,843,381 10/1974 Matsumoto et al. ..... 101/DIG. 37
4,069,759 1/1978 Endo et al. ..... 101/DIG. 37
4,205,320 5/1980 Fujii ..... 346/1.1
4,263,601 4/1981 Nishimura et al. ..... 346/1.1

FOREIGN PATENT DOCUMENTS 0107354 6/1985 Japan ..... 346/75

OTHER PUBLICATIONS

Japanese Patent Abstract No. 61-219658, Y. Hosaka, Sep. 30, 1986, vol. 11, No. 64 (M-565) (2511, Feb. 26, 1987).

Japanese Patent Abstract No. 63-34149, M. Okubo, Feb. 13, 1988, vol. 12, No. 247 (M-717) (3094) Jul. 13, 1988.

*Primary Examiner*—Benjamin R. Fuller
*Assistant Examiner*—Alrick Bobb
*Attorney, Agent, or Firm*—Nikaido, Marmelstein, Murray & Oram

[57] ABSTRACT

A recording apparatus which realizes attraction of ink with a low recording voltage, includes a thin plate member (2) having many fine holes (3). An ink reserving member (4) is provided closely in the one side of the thin plate member (2) and is impregnated with conductive ink (8). An electrode member (1) is provided interposing a recording medium (100) on the other side of the thin plate member (2) and effectuates the electrostatic force to attract the conductive ink (8) in the one side through the holes (3).

10 Claims, 11 Drawing Sheets

Fig.3
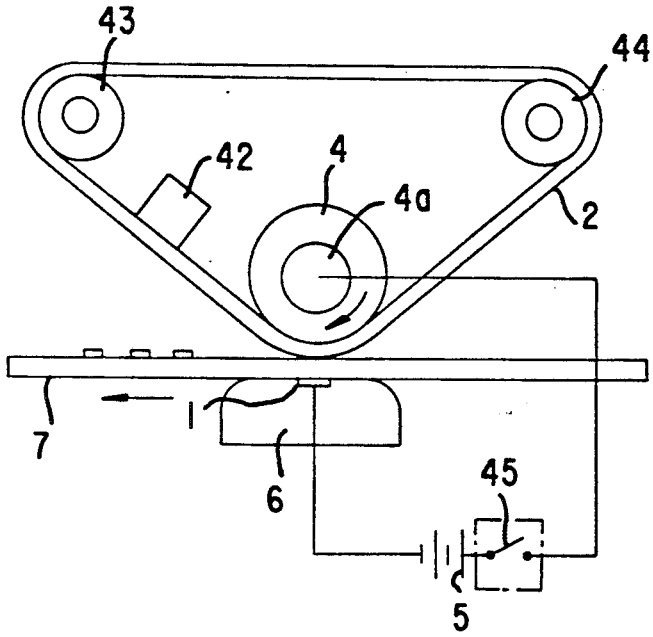
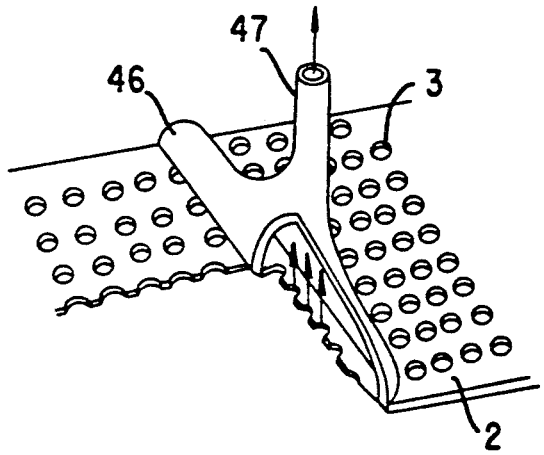
Fig.4

RECORDING APPARATUS

FIELD OF THE INVENTION

The present invention relates to a recording apparatus which realizes recording by electrostatically absorbing ink from a member impregnated with the ink and the adhereing ink on a recording medium.

BACKGROUND OF THE INVENTION

The principle of recording by absorbing ink with an electrostatic force and adhering the ink to a recording medium such as a recording sheet is disclosed in Published Japanese Patent No. 36-13768.

In these years, a variety of methods have been proposed to realize a) a reduction in size of a recording apparatus of this type and b) high resolution as explained in the Japanese Laid-open Patent Nos. 55-164175, 61-211048 and 62-44457, wherein countless number of fine holes of a mesh member are filled with ink. This ink is absorbed by electrostatic force and it is then injected and adhered onto a recording sheet.

However, since the holes of the mesh members are filled with the ink in these methods, a gap must be provided between the mesh member and the recording sheet, resulting in a problem that a recording voltage as high as 2~3 kV is required. Moreover, a high application voltage sometimes generates a leak between the adjacent electrodes and thereby gives a limit on high resolution.

Considering the problems mentioned above, it is therefore an object of the present invention to provide a recording apparatus which realizes recording only with a low recording voltage and high resolution.

DISCLOSURE OF THE INVENTION

According to the present invention, a recording apparatus provided thereby includes a thin plate member providing fine holes, an ink reserving member which is closely provided on one side of the thin plate member and is impregnated with conductive ink, and electrode members which are provided on the other side of the thin plate member in such a manner as to interpose a recording medium and to effectuate an electrostatic force to absorb conductive ink through the holes.

FIG. 1 is a diagram for explaining the recording principle of a recording apparatus of the present invention.

As shown in FIG. 1, a structure provides an electrode 1, a recording medium 100, a thin plate member (mesh) 2 having a through hole 3 extending in the thickness direction thereof and an ink (layer) 8. When the thin plate member 2 is kept dry from the ink 8 (contact angle $\theta \geqq 90°$), the ink 8 cannot enter the hole 3 if pressure is not applied (the pressure can be adjusted depending on the surface tension).

When the ink is given conductivity and a voltage is applied across the ink and electrode 1, an electrostatic force is generated between the recording sheet 100 (in the hole 3) and electrode 1 through the air layer. When the electrostatic force is larger than the surface tension of ink 8, the ink 8 enters the hole 3 and adheres to the recording medium 100.

The voltage required for such an event will then be explained hereunder.

First, the effect of surface tension of the ink is considered.

A wet angle $\theta$ between the hole 3 formed like a pipe having a radius r, and the ink 8 is considered as 90° and the surface tension of the ink is $\gamma$. The surface tension affectuates in the direction of interfering with the inflow of the ink as the force (pressure) p expressed as follows.

$$p = 2\pi r\gamma / \pi r^2 (\text{dyne/cm}^2) \quad (1)$$

When $r = 70\ \mu m$, $\gamma = 60$ dyne/cm, the pressure p becomes equal to $1.7 \times 10^4$ (dyne/cm$^2$) and when a pressure higher than p is applied, the ink enters the hole.

An electrostatic force f is considered next. When a thickness of recording medium 100 is assumed as $d_1$, a dielectric constant thereof is $\epsilon_1$, the thickness of hole 3 (air layer) is $d_2$ and the dielectric constant thereof is $\epsilon_2$, the electrostatic force f can be expressed as follows:

$$f = \frac{1}{2}\left(\frac{\dfrac{\epsilon_1 \epsilon_2}{d_1 d_2}}{\dfrac{\epsilon_1}{d_1} + \dfrac{\epsilon_2}{d_2}}\right)\frac{V_p^2}{d_1 + d_2} \times 10\ (\text{dyne/cm}^2) \quad (2)$$

When $d_1 = 60\ \mu m$, $r_1$ (specific dielectric constant of the recording medium) = 3, $d_2 = 50\ \mu m$ and $r_2$ (specific dielectric constant of air) = 1, $V_p$ for p = f becomes equal to $1.67 \times 10^3$ (V).

Namely, recording can be realized by applying a voltage higher than 1.67 kV.

Accordingly, the recording may be done with a recording voltage lower than that of the prior art.

Moreover, in case a pressure in the direction of the recording medium 100 is applied to the ink 8, the recording voltage can be lowered to 700 V or less.

As explained previously, the present invention uses a thin plate member 2 provided with holes which are not filled with the ink. Both the ink reserving member 4 and electrode 1 are closely arranged on both sides of the thin plate member 2 and thereby the recording voltage is remarkably lowered through use of the thickness of the thin plate member 2 as the gap.

Accordingly, the adjacent electrodes do not generate leaks and a close layout can be realized and thereby high resolution can also be obtained.

BRIEF DESCRIPTION OF THE DRAWINGS

FIG. 3 is a diagram for explaining a second embodiment.

FIG. 4 is a diagram for explaining a cleaning mechanism of the second embodiment.

PREFERRED EMBODIMENTS OF THE INVENTION

(a) Explanation about the first embodiment

Figure 1:
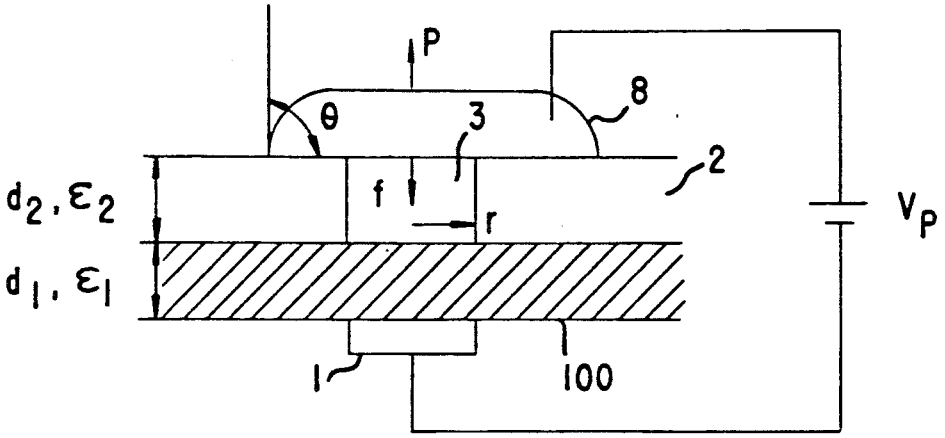
FIG. 1 is a diagram for explaining the principle of the present invention.
Figure 2:
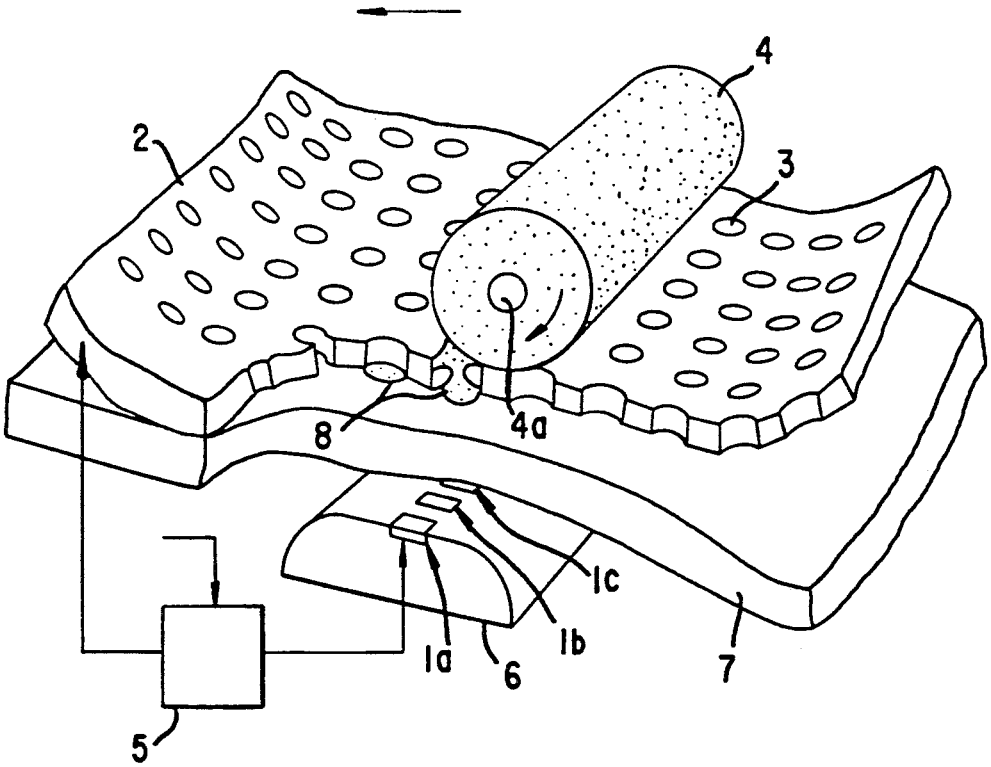
FIG. 2 is a diagram for explaining a first embodiment.

FIG. 2 is a diagram for explaining a first embodiment of a recording apparatus of the present invention.

In FIG. 2, the numerals 1*a*, 1*b*, 1*c* . . . designate many electrodes; a metal mesh member 2 is providing many holes 3; an ink roller 4 as a member is impregnated with the ink; and a power supply 5 (voltage applying means) is provided.

The electrodes 1*a*, 1*b*, 1*c* . . . are formed by burying metal members in a line with a pitch of 140 μm at the surface of a platen 6 along the axial direction of the ink supply roller 4.

A voltage of the power supply 5 is applied to the metal members 1*a*, 1*b*, . . . through well known driver circuits (not illustrated) formed to apply a voltage individually so that it can be selectively operated in accordance with a recording signal (video signal) sent from the host apparatuses. The mesh member 2 is formed, for example, by boring circular holes in a diameter of 100 μm with a pitch of 140 μm into a stainless steel plate of thickness of 60 μm. The mesh 2 is arranged on the electrodes 1*a*, 1*b*, 1*c* . . . through a recording sheet 7. The electrodes 1*a*, 1*b*, 1*c* . . . are aligned with the holes 3 and as will be explained later, the ink is adhered on the recording sheet 7 at the position corresponding to the electrode to which a voltage is applied, thereby realizing the recording operation.

The ink roller 4 is formed by fitting a member to impregnate the water conductive ink 8 to the external circumference of the conductive shaft member 4*a*. This member is, for example, formed by felt made of wool (JIS No. 3 (KF)) or a sponge type member (Everlite HPN).

The ink roller 4 is provided in pressure contact with the mesh member 2 and recording sheet 7 against the electrodes 1*a*, 1*b*, 1*c* . . .

As the physical characteristics of ink, the adequate ratio of surface tension is particularly important but it largely depends on the thickness of mesh member 2 and the diameter of hole 3 and must be adjusted within the range of 10~73 dyne/cm. Here, the ink of 61.7 dyne/cm is used. Moreover, the ink roller 4 is pressed to the mesh member 2 with a pressure of 10~100 g/cm$^2$.

Since this pressing force is subtracted from the electrostatic force f in the left side of formula (2), $V_p$ is largely reduced.

When pressure is too low, the voltage $V_p$ cannot be reduced and when pressure is too high, the ink is squeezed out from the ink roller 4 and it undersirably enters the holes 3 of mesh member 2.

The power supply 5 is connected with the electrodes 1*a*, 1*b*, 1*c* . . . and mesh member 2 and a field is generated by applying a voltage across the ink 8 supplied into the holes 3 from the ink roller 4 and the electrodes 1*a*, 1*b*, 1*c* . . . The voltage applied by the power supply 5 is related to the thickness of the recording sheet 7. Although thickness of the recording sheet 7 is not specially determined, the voltage must be increased as the recording sheet becomes thicker. Here, a recording sheet 7 having a thickness of 65 μm is used and the voltage is set to 700 V. Namely, voltage can be lowered distinctively than the calculated value by pressing the ink roller 4 with the value explained above.

Operations of the recording apparatus are as follows:

In case the field generated by the power supply 5 is not working between the ink 8 and electrodes 1*a*, 1*b*, 1*c*, . . . the surface tension of ink 8 is adjusted as explained above and thereby the ink to be supplied to the mesh member 2 by the ink roller 4 cannot enter the holes 3 and does not reach the recording sheet 7.

During the recording operation, a voltage supplied from the power supply 5 is selectively applied to the electrodes 1*a*, 1*b*, . . . by the driving circuits (not illustrated) and the field is generated between the electrode and ink 8 by applying voltage across the selected electrode, for example, to the electrode 1*a* and ink 8.

The ink 8 passes through the hole 3 provided opposed to the part of electrode 1*a* and adheres on the recording sheet 7 with the electrostatic force caused by the field.

For the printing of next line, a command is given to the motor from MPU (not illustrated) to rotate the ink roller 4 in the clockwise direction indicated by the arrow for the predetermined quantity and also rotate the mesh member 2 and recording sheet 7 in the direction indicated by the arrow for the predetermined quantity.

As explained above, since the ink 8 is caused to pass through the hole 3 by the field, the ink reserving mesh member 2 is not filled with the ink and thereby the mesh member 2 and recording sheet 7 may be pressurized in contact with each other.

Therefore, a distance between the ink roller 4 and electrodes 1*a*, 1*b*, 1*c* . . . can be shortened up to the thickness of the mesh member 2 and the voltage to be applied can be lowered.

Moreover, since the mesh member 2 operates as a gap holding mechanism, it is no longer necessary to arrange the ink roller 4, mesh member 2 and platen 6, etc. with high accuracy and thereby an economical structure may be formed.

In the above example, the mesh member 2 is formed by stainless steel, but other metal plates may also be used. In addition, the mesh member may also be formed by materials other than metal, for example, a polymer film provided with many holes. In this case, a voltage is applied to the shaft member 4*a* of the ink roller 4 which is used as the electrode.

The mesh member 2 can also be a screen formed by weaving stainless wire. This screen can be fabricated with an accuracy up to 500 mesh/inch and thereby high resolution recording can be realized.

Moreover, the stainless wire is woven flat like a screen as the mesh member 2 in the accuracy of 400 mesh/inch (wire diameter is 18 μm and gap coefficient is 51%). Such a screen mesh member 2 has realized the recording of a dot having a diameter of 50 μm on the recording sheet 100 under the recording condition as explained above.

In addition, using a screen mesh member 2 which has been obtained by weaving the string of polyamide system resin (for example, nylon string) or string of polyester system resin (for example, tetlon string) flat in the accuracy of 355 mesh/inch (wire diameter is 30 μm and gap coefficient is 37%), recording has been conducted with the application voltage of 600 v and recording energy in the pulse width of 1 ms under the other recording conditions same as those described above. Thereby, the dot having a diameter of 70 μm has been recorded on the recording sheet 100.

The nylon string can be fabricated with an accuracy up to 500 mesh/inch, while the tetlon spring up to 460 mesh/inch.

(b) Explanation about the second embodiment

FIG. 3 is a diagram for explaining the second embodiment, while FIG. 4 is a diagram for explaining the cleaning mechanism thereof.

In FIG. 3 and FIG. 4, the elements like those in FIG. 2 are designated by like reference numerals and an explanation thereof will not be repeated.

In this figure, the numeral 2 designates a mesh member. As explained for FIG. 2, countless numbers of holes 3 are provided thereto. The mesh member is formed as an endless member and is extended over the ink roller 4 and guide rollers 43, 44.

The numeral 45 designates a switch which is provided corresponding to each electrode 1*a*, 1*b*, . . . (shown as numeral 1) and is selectively turned ON and OFF in accordance with the video signal supplied from the host apparatus to apply a voltage across the metal shaft 4*a* of ink supply roller 4 and each electrode 1.

As shown in FIGS. 3, 4, the cleaning mechanism 42 provides a suction part 46 which comes close to the mesh member 2 when it has passed the recording part and a suction pipe 47 connected to this suction part 46 is also connected to a suction source (not illustrated) such as an air pump through a filter (also not illustrated).

The recording to the recording sheet 7 can be conducted in the same way as the first embodiment and the ink remaining in the hole 3 after the recording is sucked up by the cleaning mechanism 42 and thereby removed.

Therefore, the adhered ink is never left at the internal surface of hole 3 of mesh member 2 and the mesh member 2 can be used repeatedly.

After the recording of the last line of recording sheet 7, it is also allowed that the guide rollers 43, 44 are rotated for a single or more turns under the condition that a) the suction source (not illustrated) is operated and b) the recording voltage is not applied in order to move the mesh member 2 for cleaning and then these guide rollers are stopped.

(c) Explanation about the third embodiment

Figure 5:
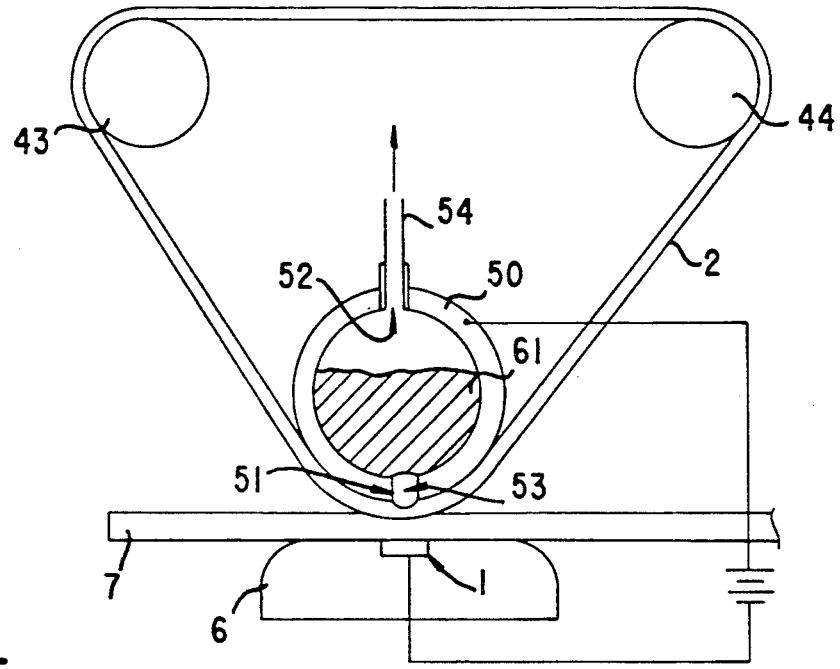
FIG. 5 is a diagram for explaining a third embodiment.

FIG. 5 is a diagram for explaining the third embodiment.

In this figure, the elements similar to respective embodiments explained above are designated by like reference numerals and an explanation thereof is not repeated here. Numeral 50 designates a hollow cylindrical member filled with the same conductive ink 61, as explained is with regard to other embodiments. The hollow cylindrical member 50 has both ends thereof closed. This hollow cylindrical member 50 is also provided with a slit 51 and an opening 52 along the center line thereof. An ink impregnating member 53, composed of felt made of wool or sponge, is fitted to the slit 51, while a tube 54 connected to a large capacity ink tank is attached to the opening 52.

This hollow cylindrical member 50 is stationary and the endless mesh member 2 slidably moves among the external circumference of this hollow cylindrical member 50.

Also in this embodiment, the cleaning operation can be conducted by providing a cleaning mechanism 42.

According to this third embodiment, since the conductive ink 61 is continuously supplied with progress of the recording operation, a recording operation for a long period of time can be realized.

(d) Explanation about the fourth embodiment

Figure 6:
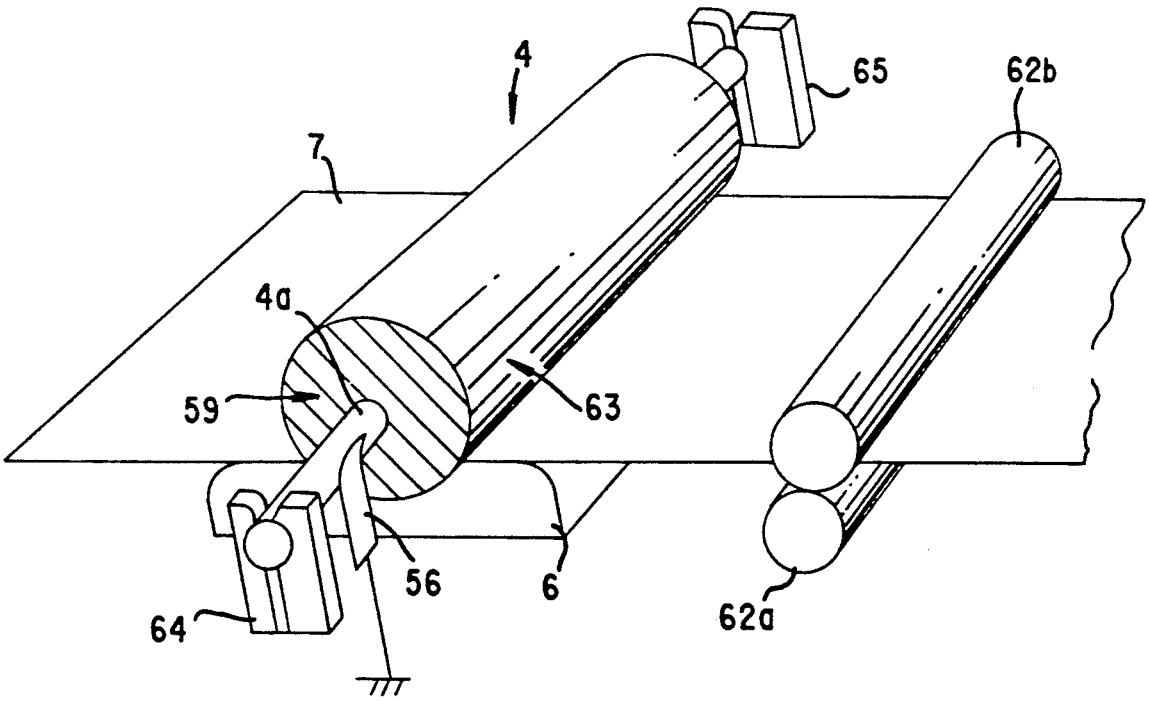
FIG. 6 is a diagram for explaining a fourth embodiment.

FIG. 6 is a diagram for explaining a fourth embodiment. In this figure, the elements like those in respective embodiments explained previously are designated by like reference numerals.

The reference numerals 62*a*, 62*b* designate recording sheet feed rollers to feed a recording sheet 7 formed like a cut sheet. An ink roller 4 comprises a sponge roller 59 composed of a sponge member impregnated with water conductive ink and a mesh member 63 which is wound around an external circumference of the sponge roller 59 in close contactness thereto and provides countless numbers of holes; Bearings 64, 65, rotatably and removably support the conductive shaft member 4*a* of the ink roller 4. A brush 56 for grounding is formed by grounded conductive brush or a conductive metal thin plate.

The recording operations of this embodiment are conducted as explained for other respective embodiments.

With progress of the recording operations, if the holes of mesh member 63 are clogged or the ink of sponge roller 59 is consumed, the ink roller 4 is removed from the bearings 64, 65.

The old ink roller 4 is replaced with a new ink roller 4 in which the sponge roller 59 is sufficiently impregnated with the ink and the holes of mesh member 63 are not clogged.

(e) Explanation about the fifth embodiment

Figure 7:
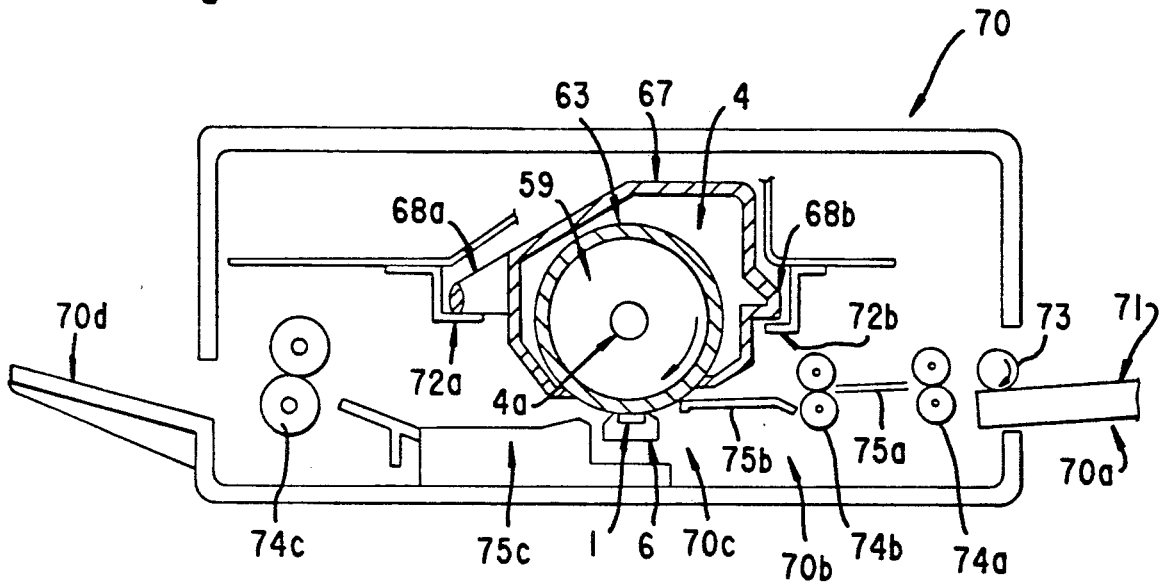
FIG. 7 is a diagram for explaining a fifth embodiment.
Figure 8:
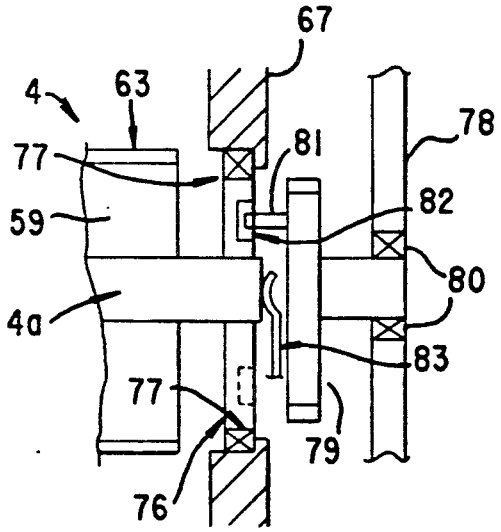
FIG. 8 is a sectional view of the essential portion of the fifth embodiment.

FIG. 7 is a diagram for explaining the fifth embodiment and FIG. 8 is a sectional view of the essential portion thereof. The elements like those in the respective embodiments explained above are designated by like reference numerals.

In these figures, the numeral 4 designates an ink roller; 59, a sponge roller; 63, a mesh member; 67, a cartridge case accommodating therein the sponge roller 59 and ink roller 4 including mesh member 63 and providing guiding projections 68*a*, 68*b* at the side surfaces thereof. A recording apparatus body 70 comprises a cassette loading part 70*a* to which a sheet cassette 71 holding cut sheets is loaded, a sheet transfer part 70*b* for carrying cut sheets, a recording part 70*c* for conducting recording on the cut sheets and a stacker part 70*d* to which recorded cut sheets are exhausted. Moreover, the guide rails 72*a*, 72*b* are also provided for guiding the guiding projections 68*a*, 68*b* on the occasion of inserting or removing the cartridge case 67 along the axial direction of the ink roller 4.

The loading part 70*a* is provided with a pick roller 73 for feeding cut sheets in the sheet cassette 71. The sheet transfer part 70*b* is provided with the guide rollers 74*a*, 74*b*, 74*c* and guide plates 75*a*, 75*b*, 75*c* for carrying the cut sheets to the recording part 70*c* and stacker part 70*d*. The recording part 70*c* is provided with a platen 6 on which the electrode 1*a*, 1*b*, . . . are arranged in the axial direction of ink roller 4 at the positions opposed to the ink roller 4.

The platen 6 is formed so that it is set, by a lever member which is manually operated by an operator, to the position where the electrodes are pressurized in contact with the ink roller 4 by a preset pressure and to the position where it is separated from the ink roller 4 when the device is in a jamming condition of the cut sheets and the cartridge case 67 is inserted or removed.

Moreover, as shown in FIG. 8, the one end side of the cartridge case 67 is provided with a bearing 77 which rotatably holds the flange 76 disposed to the conductive shaft member 4*a* of ink roller 4 a drive gear 79 which is engaged with the gear train driven by a motor (not illustrated) is rotatably held by the bearing 80 at the side wall 78 of recording apparatus body 70.

This drive gear 79 has a pin member 81 projected in parallel with the shaft to rotatably drive the ink roller 4 consisting of the sponge roller 59 and mesh member 63 through engagement with the hole 82 provided in the flange 76.

The shaft member 4*a* is grounded at the other end thereof when the cartridge case 67 is inserted and is in contact with pressure with a metal plate spring 83 supported by a frame (not illustrated).

With such a structure, an operator is capable of replacing the ink roller 4 consisting of the sponge roller 59 and mesh member 63 only by removing or inserting the cartridge case 67.

(f) Explanation about the sixth embodiment

Figure 9:
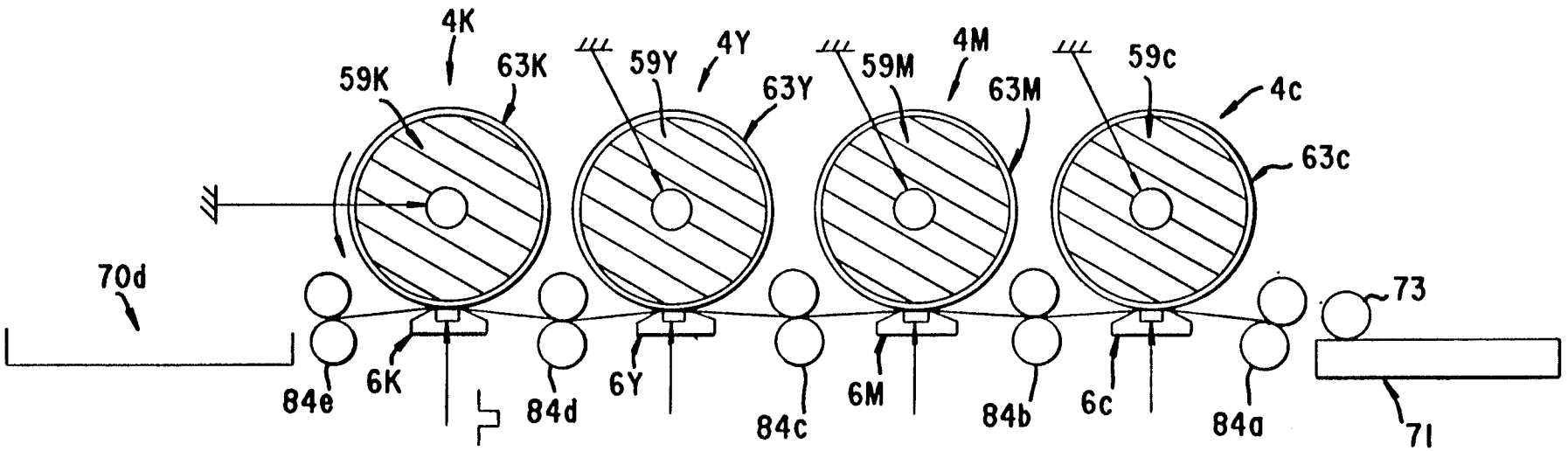
FIG. 9 is a diagram for explaining a sixth embodiment.

FIG. 9 is a diagram for explaining the sixth embodiment. In this figure, the reference numeral 4 designates an ink roller consisting of ink rollers 4*c*, 4*m*, 4*y*, 4*k* impregnated with ink of various colors. The ink roller 4*c* is impregnated with cyan ink, while the ink roller 4*m* with magenda ink, ink roller 4*y* with yellow ink and ink roller 4*k* with black ink, respectively.

The ink rollers 4*c*~4*k* comprise the sponge rollers 59*c*~59*k* and mesh members 63*c*~63*k* wound around the entire circumference of sponge rollers as shown in FIG. 6 and FIG. 7 and the platens 6*c*~6*k* providing electrodes 1*a*, 1*b*, . . . are provided opposed to the ink rollers.

In this embodiment, color recording is carried out by the following process that the positioning is carried out by the ink rollers 4*c*~4*k* while the cut sheet fed from the pick roller 73 is carried to the stacker 70*d* by the transfer rollers 84*a*~84*e* and various inks are adhered.

Since the quantity of ink to be adhered can be varied depending on the pulse width to be applied to the electrodes, full color recording can also be realized.

(g) Explanation about the seventh embodiment

Figure 10:
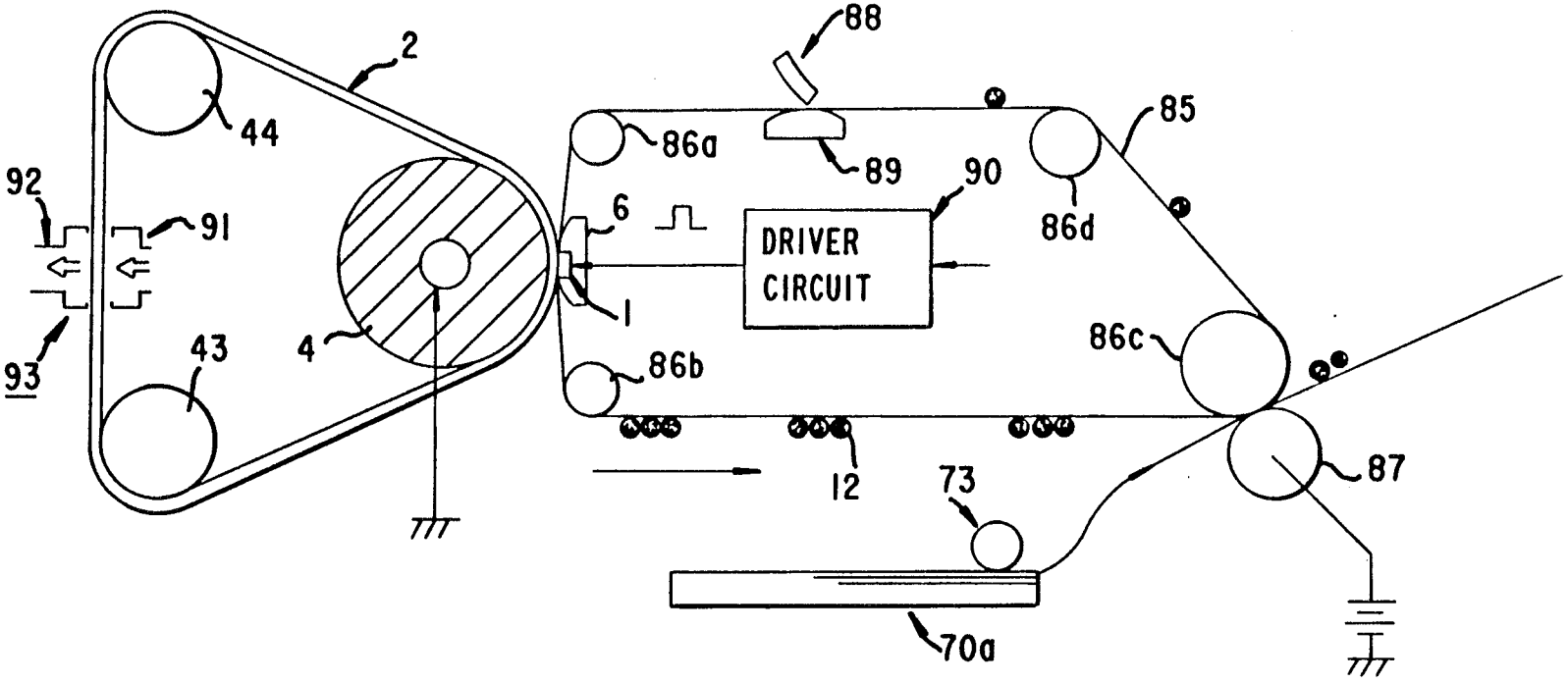
FIG. 10 is a diagram for explaining a seventh embodiment.

FIG. 10 is a diagram for explaining the seventh embodiment and the elements like those explained with regard to the embodiments described above are designated by like reference numerals.

In this figure, numeral 85 designates an intermediate transger material which is extended over the rollers 86*a*~86*d*. This material is, for example, polyethylene telephthalate (PET) or myler film, etc. which has insulation properties and does not allow impregnation of water ink and holds it at the surface thereof. The numeral 87 designates a transfer roller to which a voltage of reverse polarity to the polarity of voltage applied to the electrodes 1*a*, 2*b*, . . . is applied to transfer the ink on the intermediate transfer material 85 to the sheet by interposing the cut sheet transferred in cooperation with transfer roller 86*c* through the intermediate transfer material 85. A cleaning blade 88 interposes the intermediate transfer material 85 in cooperation with the platen member 89 to remove the remaining ink. A driving circuit 90 selectively applies a voltage to the electrodes 1*a*, 1*b*, . . . in accordance with the drive signal supplied from the host apparatus.

In the structure explained above, recording can be made under the recording conditions similar to that explained above by setting the thickness of intermediate transfer material 85 to 65 μm.

Figure 11:
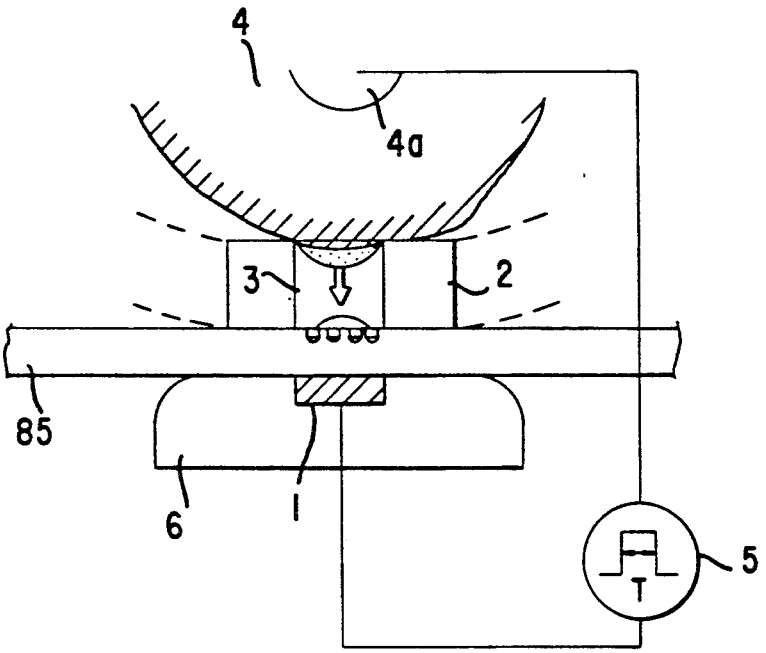
FIG. 11 is a diagram for explaining recording operations of the seventh embodiment.

Namely, the recording operation is carried out in the same way as the embodiments explained above, charges are generated on the intermediate transfer material 85 as shown in FIG. 11 by receiving the field and the ink which has passed through the holes 3 is deposited on the intermediate transfer material 85. An ink image 12 formed on the intermediate transfer material 85 as explained above is transferred to the recording sheet 7 between the transfer roller 86*c* and transfer roller 87 by adhering it to the recording sheet 7. Moreover, the ink adhered to the holes of mesh member 63 is removed by the cleaning mechanism 93, providing a blowing port 91 and a suction port 92, and the cleaning blade 88 is used for cleaning the intermediate transfer material 85.

As the ink roller 4, those constituted as shown in FIG. 6 and FIG. 7 may be used.

Moreover, the drive circuit 90 is connected to apply a voltage across the ink of ink roller 4 and the electrode 1 and is provided with a control system for adjusting the application voltage within the determined range. In this embodiment, the voltage adjusting range is set to 400~700 V.

When the voltage to be applied across the ink and electrode 1 is in the range of 400~700 V, the ink is adhered to the recording sheet 7 in such a quantity as is almost proportional to the voltage. Namely, the drive circuit 90 receives a gradation signal supplied from the host apparatus and controls the voltage to be individually applied to each electrode 1 in the side of platen 6 in order to realize concentration gradation of recording in units of dots. The full color recording can be realized by executing such an operation four times for yellow, magenta, cyan and black colors on the same recording sheet as shown in the embodiment of FIG. 9.

In addition, the drive circuit 90 may be formed to be able to apply a pulse of 400 V across the ink roller 4 and electrode 1 with a duration T of 0~8 msec.

Figure 12:
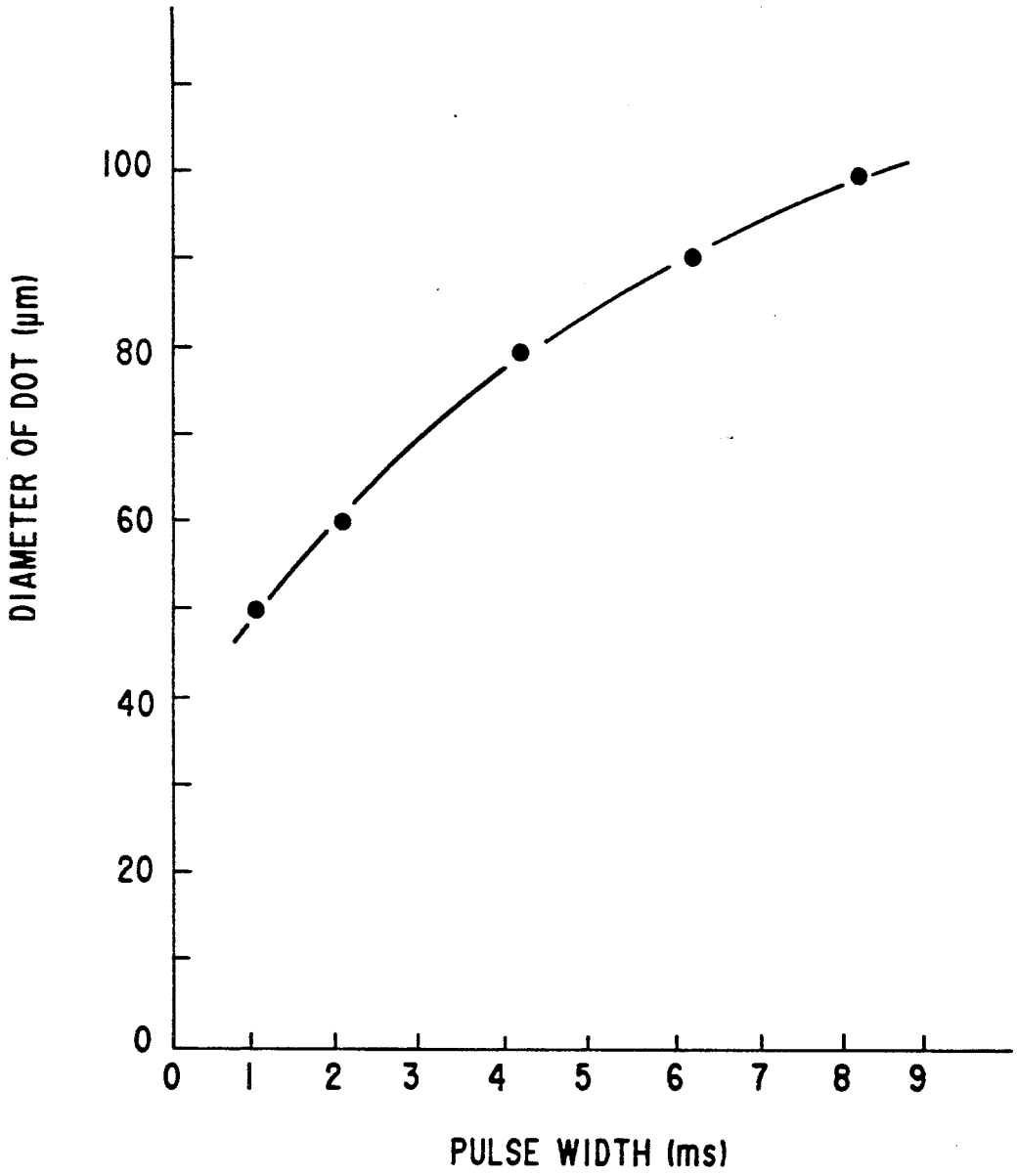
FIG. 12 is a diagram for explaining operations of the seventh embodiment.

As explained above, recording is carried out as shown in FIG. 11 in the procedures explained previously. In this case, the quantity of ink adhered to the intermediate transfer material 85 passing through the holes 3 becomes larger as the duration of the pulse to be applied becomes longer. In other words, as shown in FIG. 12, when the pulse width is changed, the dot diameter on the recording sheet becomes larger as the pulse duration becomes longer. Accordingly, the gradation recording can be realized in units of dots by controlling the pulse width.

(h) Explanation about the eighth embodiment

Figure 13:
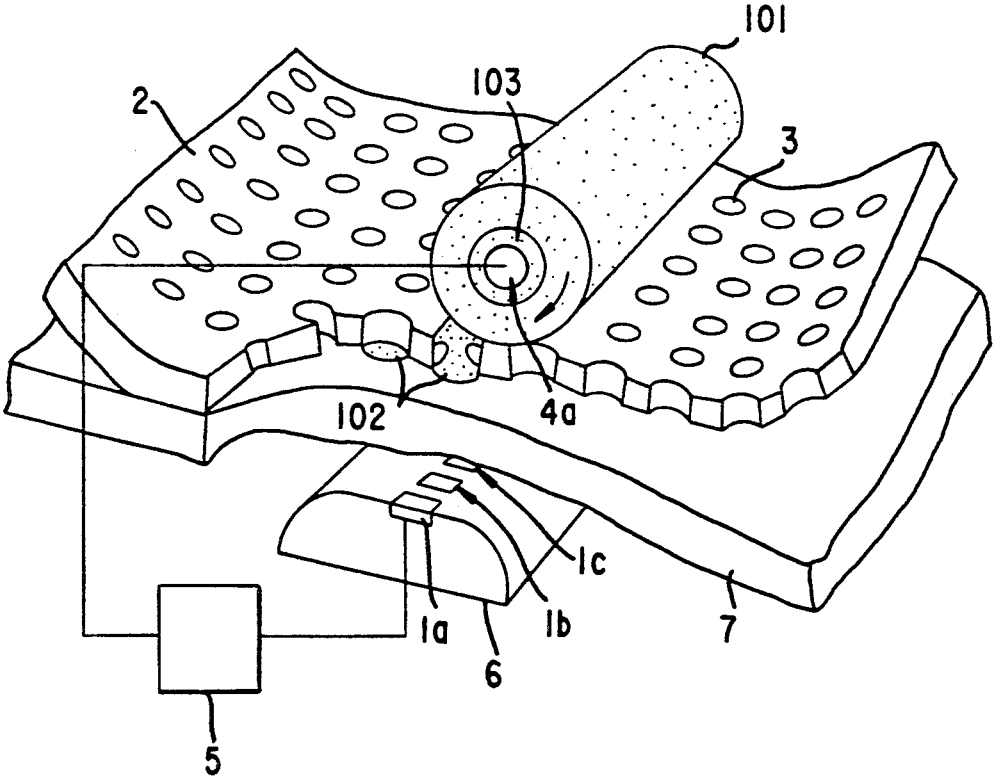
FIG. 13 is a diagram for explaining an eighth embodiment.

FIG. 13 is a diagram for explaining the eighth embodiment and the elements like those in the embodiments explained above are designated by like reference numerals.

An ink roller 101 is made of a sponge roller having the structure like the ink roller 4 described previously impregnated with the conductive wax ink 102. This ink roller 101 also comprises a heater (heat source) 103 for controlling the temperature with a temperature sensor (not illustrated) and the drive circuit so that the wax ink 102 is adjusted to the adequate viscosity during the recording operation.

The power source 5 is connected across the electrode (1*a*, 1*b*, 1*c*) and ink roller 101 to generate an electric field by selectively applying voltage across the electrode during the recording operation as explained previously. The mesh member 2 is heated by a transfer roller, not illustrated, which may be provided to transfer the mesh member 2 so that the wax ink supplied to the holes 3 from the ink roller 101 is no longer solidified. This transfer roller may be used as the guide roller 44 in FIG. 3.

The conductive wax ink 102 is generated by mixing dye, polyethylene glycol, glycerine and water and has a melting point of 60° C. and it is heated up to about 80° C. during the recording operation. For the physical characteristics of the heated and dissolved ink, the normalization of surface tension is very important as explained previously and the wax ink used in this embodiment has a surface tension of 51.0 dyne/cm.

For the recording operation, the mesh member 2 is heated and kept at the predetermined temperature as explained above and the ink roller 101 is also heated to dissolve the wax ink 102. The wax ink 102 passes through the holes 3 with an electrostatic force and adheres on the recording sheet 7 for recording by generating an electric field through selective application of the voltage across the wax ink 102 and electrode 1.

For this embodiment, an effect similar to that of the first embodiment can be obtained and moreover since the wax ink 102 is used, the ink adhered to the recording sheet 7 under a normal temperature condition does not penetrate too much and is quickly solidified and fixed on the recording sheet 7, resulting in clear recording.

(i) Explanation about the ninth embodiment

Figure 14:
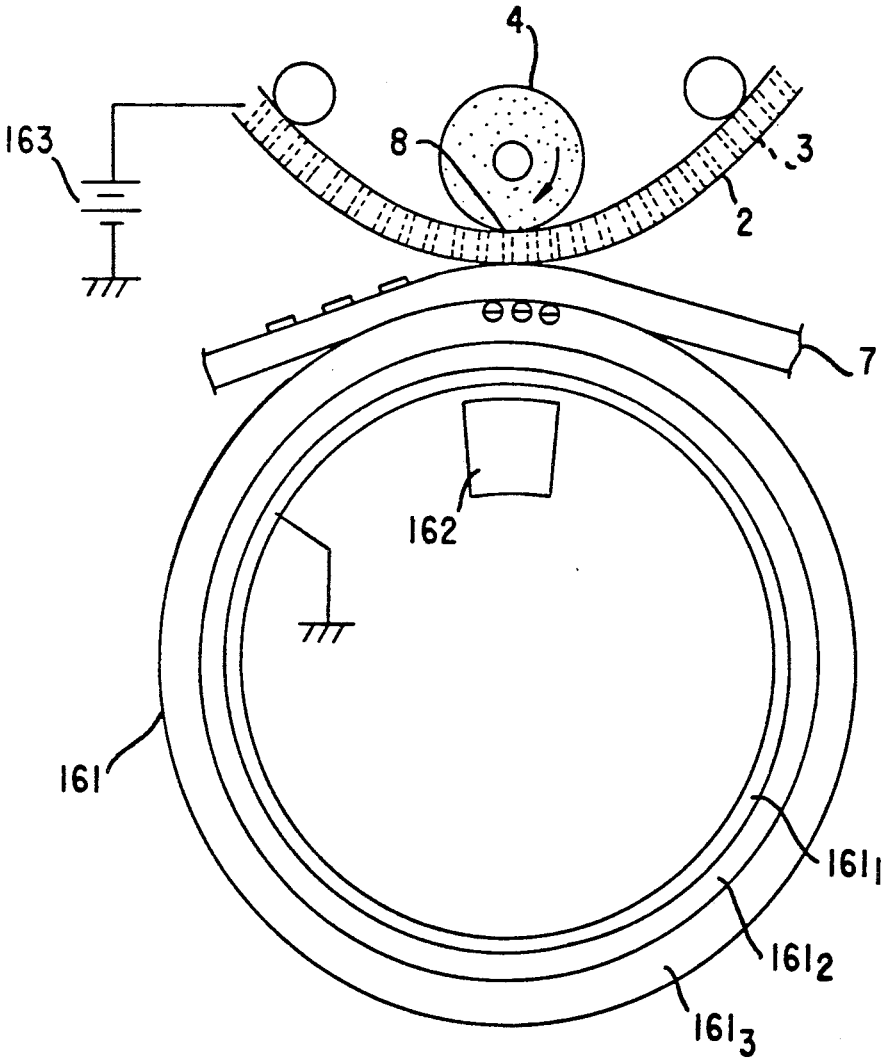
FIG. 14 is a diagram for explaining a ninth embodiment.

FIG. 14 is a diagram for explaining the ninth embodiment and the elements and the elements like those in the embodiments described above are designated by like reference numerals.

In this figure, a photosensitive drum 161 is formed by sequentially forming a charge generating layer $\mathbf{161}_2$ and a charge transfer layer $\mathbf{161}_3$ on the grounded transparent electrode $\mathbf{161}_1$ and is pressurized in contact with the ink roller 4 through the recording sheet 7 and mesh member 2.

The exposure optical system 162 is provided inside (in the side of transparent electrode $\mathbf{161}_1$) of photosensitive drum 161 and is opposed to the ink roller 4. Since the exposure optical system 162 is provided in the inside of photosensitive drum 161, the LED array optical system and liquid crystal shutter array optical system will be rather desirable than the large size laser scanning optical system because these are small in size.

The power supply 163 supplies a voltage across the mesh member 2 and transparent electrode $\mathbf{161}_1$. The voltage to be applied is set to 700 V.

During the recording operation, charges are generated by irradiating the charge generating layer $\mathbf{161}_2$ with light through the transparent electrode $\mathbf{161}_1$ by the exposure optical system 162 in accordance with the video signal supplied from the host apparatus. This charge reaches the surface of charge transfer layer $\mathbf{161}_3$ due to the field by the power supply 163, resulting in an increase of electrostatic force to be applied on the ink 8. In the lower electric field wherein no charges are generated at the surface of the photosensitive drum 161, the ink 8 cannot pass through the holes 3 of mesh member 2. On the other hand, when charges are generated by exposure at the surface of photosensitive drum 161 in order to intensify the field to be applied on the ink 8, sufficient electrostatic force works on the ink 8 and thereby the ink 8 passes through the holes 3 and adheres to the recording sheet 7.

In this embodiment, the photosensitive drum has been used but a belt type photosensitive material may also be used. In addition, it is also possible that the ink is adhered directly on the photosensitive drum without the existence of recording sheet 7 as shown in FIG. 10 and it is then transferred to the recording sheet in another place through application of electrostatic force and pressure.

(j) Explanation about the tenth embodiment

Figure 15:
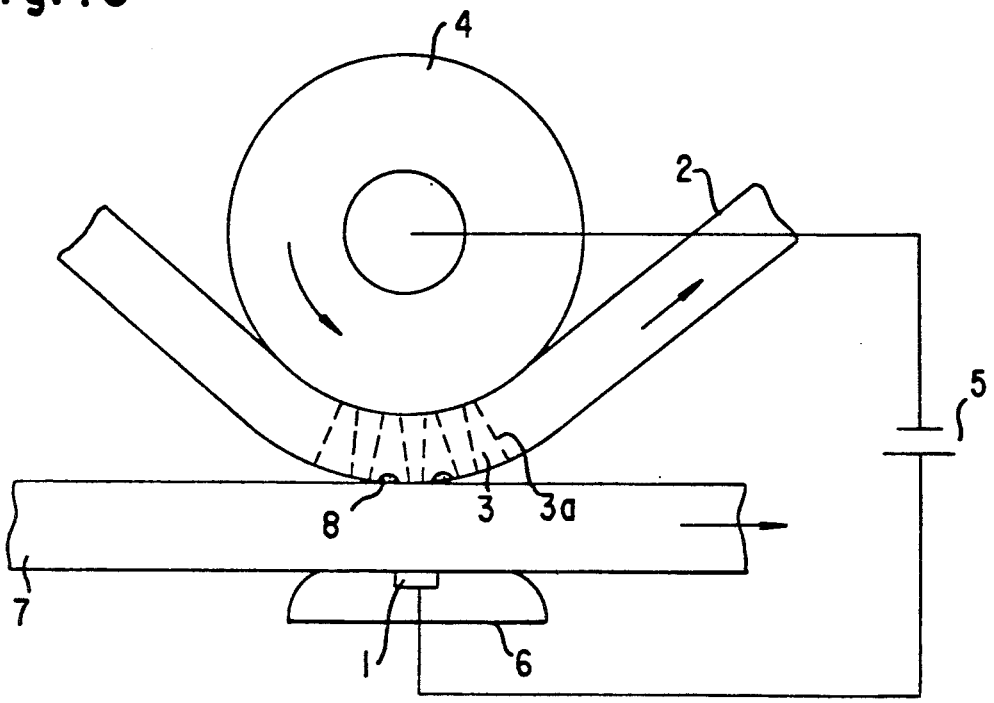
FIG. 15 is a diagram for explaining a tenth embodiment.
Figure 16:
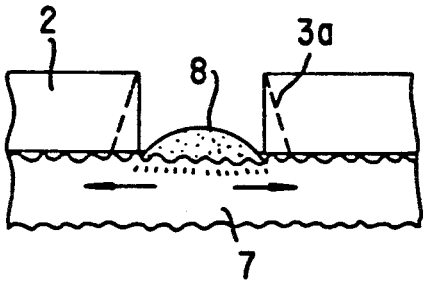
FIG. 16 is a diagram for explaining operations of the tenth embodiment.

FIG. 15 is a diagram for explaining the tenth embodiment. FIG. 16 is a diagram for explaining the operations thereof. The elements like those in the embodiments explained previously are designated by like reference numerals.

In these figures, the mesh member 2 is provided with many fine holes 3 which are tapered 3*a* so that the upper side (in the ink roller side 4) is smaller in diameter. This mesh member 2 is provided with the tapered holes bored on the stainless steel plate in diameters of 160 μm and 80 μm with the pitch of 200 μm.

The ink roller 4 supplies the conductive ink to the holes 3 of mesh member 2 and the roller may be formed by a material which may be impregnated with the conductive ink and it is here formed by sponge.

The electrode 1 is formed by burying the metal pieces into the surface of platen 6 in the pitch of 200 μm. The mesh member 2 is arranged with the larger diameter side of the holes 3 placed in contact with the recording sheet 7. Both members are interposed in contact with pressure between the ink roller 4 and the surface on the side of forming the electrode 1 of the platen 6. The power supply 5 generates an electric field by applying a voltage across the conductive ink and electrode 1 and is connected with the ink roller 4 and electrode 1.

As the conductive ink held by the ink roller 4, water ink is used. As the physical characteristic of ink, adequacy of surface tension is particularly important, but it largely depends on material, thickness and diameter of the holes of the ink reserving material of ink roller 4 and the surface tension must be adjusted in the range of 10~73 dyne/cm. In this case, the ink has the surface tension of 61.7 dyne/cm as explained above. In addition, the recording sheet 7 is not particularly regulated in thickness but when the recording sheet becomes thicker, the voltage to be applied must be increased. Here, the recording sheet used has the thickness of 65 μm.

For the recording operation, the ink roller 4 is rotated counterclockwise as indicated by the arrow and both mesh member 2 and recording sheet 7 are synchronously moved in the direction indicated by the arrows. An electric field is generated by selectively applying the voltage with the power supply 5 across the ink roller 4 and specified electrode 1 in a predetermined timing. Accordingly, an electrostatic force is applied to the ink (which cannot enter the holes 3 of mesh member 2 because wettability to the mesh member 2 is low) and the ink passes through the holes 3 and adheres to the recording sheet 7 for the recording purpose.

If the holes 3 are not tapered in such a recording operation, the ink 8 penetrates in the lateral direction (direction indicated by the arrow mark) as shown in FIG. 16 with capillary force at the interface of the mesh member 2 and recording sheet 7, deteriorating the recording quality. However, in the case of this embodiment, since the holes 3 are tapered 3*a*, the distance between the edge of the ink 8 having reached the recording sheet 7 and mesh member 2 becomes longer and the ink 8 does not penetrate in the lateral direction.

Therefore, recording quality is no longer deteriorated. For example, when recording is carried out on the recording sheet with an energy of a pulse width of 1 ms under the application voltage by power supply 5 of 700 V, a dot having a diameter of 120 μm can be obtained on the recording sheet 7 without any penetration of ink.

(k) Explanation about the eleventh embodiment

Figure 17:
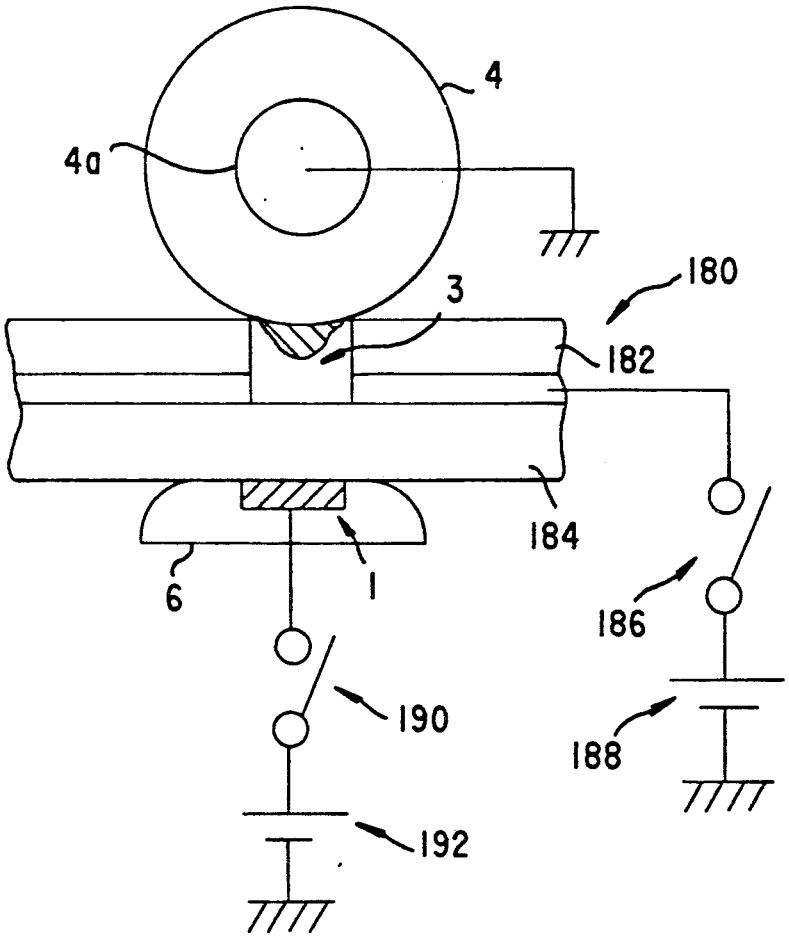
FIG. 17 is a diagram for explaining an eleventh embodiment.
Figure 18A:
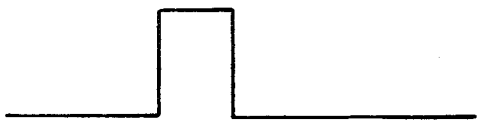
FIGS. 18(*a*)-18(*b*) are diagrams for explaining operations of the eleventh embodiment.
Figure 18B:
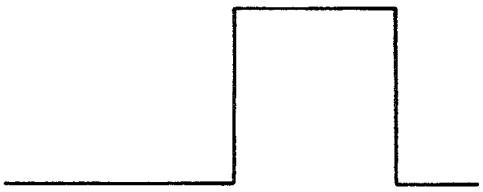

FIG. 17 is a diagram for explaining the eleventh embodiment and FIGS. 18(*a*)-18(*b*) are diagrams for explaining operations thereof. The elements like those in the embodiments explained above are designated by like reference numerals.

In these figures, the mesh member 180 is formed by stretching together a polymer 182 (for example, polyethylene telephthalate) having insulation properties in the thickness of 40 μm and a conductive material 184 such as stainless steel in the thickness of 10 μm and then providing many holes 3 in diameter of 60 μm with the pitch of 100 μm. The polymer 182 and the conductive member 184 are given a water repellent property.

The shaft member 4*a* of ink roller 4 is grounded. A voltage of 400 V is applied to the conductive member 184 from the power supply 188 through the switch 186 and a voltage of 500 V is applied to the electrodes 1 (1*a*, 1*b*, . . . ) from the power supply 192 through a switch 190.

The ink roller 4 is impregnated with water conductive ink having a surface tension of 62 dyne/cm and a recording is carried out under the conditions mentioned previously.

During the recording operation, the switch 190 is first turned ON as shown in FIG. 18(*a*) and a voltage pulse of 200 V (duration of 0.3 ms as shown in FIG. 18(*a*)) is applied to the conductive member 184. Thereby, as shown in FIG. 17, the ink rises up toward the holes 3 of mesh member 180.

Under this condition, when the voltage pulse of 500 V (duration of 0.7 ms as shown in FIG. 18(*b*)) is applied to the electrodes 1*a*, 1*b*, . . . corresponding to the dot position to be recorded, the ink flies toward thee recording sheet 7 and adheres thereto for recording purpose.

As explained above, when a low voltage and short duration pulse is applied prior to application of the recording pulse to the electrodes 1*a*, 1*b*, . . . , the recording pulse voltage may be lowered to 500 V from the 700 V which has been used in the prior art. Thereby, further improvement in simplified structure and reduction in size of the recording apparatus can be realized.

In the above explanation, a recording sheet is used as the recording medium, but it is also possible to use a film such as polyester as the recording medium, initially form an image on this film and then transfer the image to the recording sheet. In this case, the recording sheet may be selected from a wide range of materials and the voltage to be applied may also be set to a constant and lower value. Since the ink does not penetrate into the film (dried up), the ink easily penetrates into the interface between the mesh member 2 and film but any problem does not occur because the distance between the edge of the ink and the mesh member 2 is sufficient due to the tapered formation.

In addition, in the above explanation, the stainless plate is used for the mesh member 2 but the material of mesh member 2 is not restricted only to metal and for example, a polymer film providing many holes with small pitch can also be used. In this case, a voltage is applied to the shaft of ink roller as the electrode.

In this embodiment, the holes are tapered so that the daimeter of each hole on the side of the recording sheet is made larger, but it is also possible to form a stepped portion for the same purpose.

Moreover, the round holes 3 are provided in the respective embodiments described above but it is also possible to form slits along the moving direction of the mesh member. In this case, the slit may be provided one by one corresponding to each electrode and many slits and round holes may be formed corresponding to the electrodes.

APPLICABILITY IN INDUSTRY

The present invention realizes deposition of ink to the recording medium by attracting the ink with a low recording voltage and thereby remarkably improves reduction in size and high resolution of the recording apparatus.

What is claimed is:

1. A recording apparatus comprising:

a thin plate member provided with holes;

an ink reserving member which is provided closely on one side of said thin plate member and is impregnated with conductive ink; and electrode members arranged to interpose a recording medium on another side of said thin plate member, each electrode member applies an electrostatic force to attract said conductive ink on said one side of said thin plate member through said holes;

wherein a part of said conductive ink impregnated in said ink reserving member is attracted toward said recording medium through said holes of said thin plate member when said electrostatic force is applied by said electrode members.

2. A recording apparatus according to claim 1, wherein said ink reserving member is a roller member, said conductive ink is a conductive wax ink and said roller member comprises a heat source to dissolve and conductive wax ink.

3. A recording apparatus comprising;

a photosensitive material providing a transparent electrode layer, a charge generating layer and a charge transfer layer;

an exposure optical system provided inside of the transparent electrode of said photosensitive material;

a mesh member having many fine holes and being provided to be in contact with said photosensitive material through a recording medium on an opposite side of said exposure optical system;

an ink impregnated member which is impregnated with conductive ink and supplies said conductive ink to said holes through said mesh member pressurizingly in contact therewith in a position opposed to said exposure optical system; and a voltage supplying means for supplying a voltage across said conductive ink and said transparent electrode;

therein said conductive ink is caused to pass through said holes and is adhered on said recording medium by means of charges induced on a surface of said photosenitive material with irradiation of light from said exposure optical system and an electric field generated between said ink and transparent electrode by said voltage applying means.

4. A recording apparatus according to claim 1, wherein said thin plate member is a mesh member having many fine holes.

5. A recording apparatus according to claim 1 or 4, wherein each hole has a larger diameter on a side of said recording medium than on a side of said ink reserving member.

6. A recording apparatus according to claim 1, wherein said thin plate member is a screen formed by weaving a fine lead.

7. A recording apparatus according to claim 1, wherein said fine lead is polyester system resin or polyamide system resin or stainless lead.

8. A recording appartus according to claim 1, wherein said recording medium is a recording sheet.

9. A recording apparatus according to claim 1, wherein said recording medium is an endless insulator materail and a transfer means for transferring the conductive ink deposited on said insulator material to the recording sheet is further provided.

10. A recording apparatus according to claim 1, wherein said thin plate member is formed by stacking an insulator member and a conductive member, arranging said insulator member on a side of said ink reserving member and said conductive member arranged on a side of said recording medium, and a voltage applying means for applying a voltage to said conductive member prior to application of voltage to said electrode is further provided.

* * * * *